US005441254A

United States Patent [19]

Besemann

[11] Patent Number: 5,441,254

[45] Date of Patent: Aug. 15, 1995

[54] APPARATUS FOR MANIPULATING SHEETS OR WEBS OF PAPER

[75] Inventor: Alfred Besemann, Halstenbek, Germany

[73] Assignee: E.C.H. Will GmbH, Hamburg, Germany

[21] Appl. No.: 272,685

[22] Filed: Jul. 8, 1994

Related U.S. Application Data

[62] Division of Ser. No. 922,054, Jul. 29, 1992, Pat. No. 5,363,730.

[30] Foreign Application Priority Data

Aug. 3, 1991 [DE] Germany ..... 41 25 805.3
Oct. 18, 1991 [DE] Germany ..... 41 34 458.8

[51] Int. Cl.[6] ..... B65H 39/10

[52] U.S. Cl. ..... 271/299; 271/223; 271/236; 271/198

[58] Field of Search ..... 271/213, 220, 223, 224, 271/198, 200, 292, 293, 299, 236, 238

[56] References Cited

U.S. PATENT DOCUMENTS

| | | | |
|---|---|---|---|
| 4,484,736 | 11/1984 | Osburg | 271/220 |
| 4,509,740 | 4/1985 | Foresi | 271/224 |
| 4,767,115 | 8/1988 | Garthe | 271/223 |
| 4,770,406 | 9/1988 | Bodewein | 271/223 |
| 4,775,141 | 10/1988 | Trenzen | 271/223 |
| 4,787,621 | 11/1988 | Sattler | 271/221 |
| 4,838,538 | 6/1989 | Baba | 271/238 |

FOREIGN PATENT DOCUMENTS

| | | | |
|---|---|---|---|
| 3536859 | 4/1987 | Germany . | |
| 3601294 | 7/1987 | Germany . | |
| 3601295 | 7/1987 | Germany . | |
| 3712103 | 10/1988 | Germany . | |
| 4216123 | 11/1993 | Germany | 271/223 |

*Primary Examiner*—H. Grant Skaggs
*Attorney, Agent, or Firm*—Darby & Darby

[57] ABSTRACT

Apparatus for manipulating streams of discrete sheets or webs of coherent sheets has a frame for a carriage which supports several tools for depression, alignment, orientation, stoppage, severing, flexing and/or other manipulation of sheets. At least some of the tools are adjustable in or counter to the direction of advancement of sheets and/or transversely of the direction of advancement of sheets in order to change the setup for the manipulation of different sheets or for a different manipulation of sheets. The operation of the parts which serve to adjust the tools can be automated, and such parts comprise a locating device which is movable longitudinally or transversely of the path for the sheets or web and can be coupled to two or more discrete distancing elements which are affixed to or form part of holders for the tools. The locating device is movable with as well as relative to a carriage which is movable in and counter to the direction of advancement of sheets or web toward a stacking, severing or other treating station.

18 Claims, 7 Drawing Sheets

APPARATUS FOR MANIPULATING SHEETS OR WEBS OF PAPER

This is a division of application Ser. No. 07/922,054, filed Jul. 29, 1992 and now U.S. Pat. No. 5,363,730.

BACKGROUND OF THE INVENTION

The invention relates to apparatus for manipulating sheets or webs of paper or like material. More particularly, the invention relates to improvements in apparatus which can be utilized to stack discrete sheets of paper, cardboard, metallic or plastic foil, textile material, paperboard or the like, to sever webs or strips of coherent sheet-like products, or to stamp, punch and/or otherwise deform discrete sheet-like products. Still more Particularly, the invention relates to improvements in apparatus of the type wherein discrete or coherent sheets of paper or the like are transported along a predetermined path.

It is known to treat running webs or strips of paper or the like, or to treat sheets which form one or more streams of non-overlapping or partially overlapping sheets while the webs, strips or sheets are in motion. The tools which are used for such treatment can include severing, trimming, depressing, flexing, aligning, orienting, arresting and/or other types of tools. If an apparatus employing such tools is to be set up for a different treatment, e.g., for stacking of larger or smaller sheets, the shifting of one or more tools to a different position takes up a substantial amount of time with attendant losses in output due to prolonged idleness of the apparatus. The situation is aggravated if one or more tools must be shifted to a new position by moving them in several directions. For example, it is often necessary to move one or more aligning, orienting, depressing or flexing tools in or counter to the direction of advancement of discrete sheets or webs as well as transversely of such direction. This situation will arise if an apparatus is used to stack discrete sheets which are delivered in the form of two or more streams of non-overlapping or partially overlapping (imbricated) sheets so that the, sheets are simultaneously gathered into two or more stacks of fully overlapping sheets. Stacking of the sheets can be preceded by severing of a relatively wide web into two or more narrower webs or strips and by cross cutting of the strips at regular intervals to form a corresponding number of streams of non-overlapping or partially overlapping sheets. The tools which are employed at the stacking station can include aligning devices which are adjacent the longitudinally extending marginal portions of sheets advancing toward one or more stacking locations, devices which serve to flex and thereby stiffen selected portions of successive sheets of each stream, devices which depress the sheets in order to maintain each sheet in a predetermined path during advancement to the stacking station, as well as devices which serve as stops to arrest the oncoming sheets at the stacking station. At least some of these tools must be adjusted (by moving them to different positions) when the apparatus is to be set up for the treatment of sheets having a format other than that of the previously treated sheets. Automatic Or semiautomatic adjustment of tools in accordance with heretofore known proposals is a complex and time-consuming procedure which invariably involves longer-lasting idleness of the apparatus. The situation is aggravated if the apparatus forms part of a production line which employs a series of various machines and/or apparatus because prolonged idleness of a single apparatus necessitates stoppage of the entire production line with attendant huge losses of output.

The situation is analogous in an apparatus which is utilized to subdivide a relatively wide web of paper or the like (i.e., a web of coherent sheet-like products) into two or more narrower webs or Strips which are thereupon convoluted to form discrete rolls or are acted upon by one or more cross cutters to yield discrete streams of non-overlapping or partially overlapping sheets ready to be stacked and/or otherwise treated prior to packaging and storage or shipment to customers. If the web is to be subdivided into a different number of strips or into two or more strips having widths different from those of the previously formed strips, the knives which sever the web must be adjusted by moving them transversely of the path for the web. This, too, takes up substantial amounts of time and results in losses of output.

OBJECTS OF THE INVENTION

An object of the invention is to provide an apparatus which can be utilized for the manipulation of discrete or coherent sheet-like products and which can be rapidly adjusted to change the nature of manipulation of such products.

Another object of the invention is to provide the above outlined apparatus with novel and improved means for changing the positions of tools which are used for the treatment of sheet-like products of paper, cardboard, foil, textile material or the like.

A further object of the invention is to provide a novel and improved apparatus for stacking paper sheets or the like.

An additional object of the invention is to provide a novel and improved apparatus for subdividing a running web of paper or the like into narrower webs or strips.

Still another object of the invention is to provide novel and improved tools for use in the above outlined apparatus.

A further object of the invention is to provide novel and improved means for changing the positions of tools in the above outlined apparatus.

An additional object of the invention is to provide a novel and improved tool which can be used in the above outlined apparatus to maintain streams of discrete sheet-like products or strips or webs of coherent sheet-like products in a predetermined plane.

Still another object of the invention is to provide novel and improved carriages, holders, supports and guides for tools in the above outlined apparatus.

A further object of the invention is to provide a novel and improved method of manipulating discrete sheet-like products on their way toward as well as at a stacking station.

Another object of the invention is to provide a novel and improved method of manipulating webs or strips of coherent sheet-like products in an apparatus which is used to subdivide the webs or strips into narrower webs or strips.

An additional object of the invention is to provide the apparatus with novel and improved means for accelerating the transfer of two or more discrete tools to different positions.

Still another object of the invention is to provide a production line which employs the above outlined apparatus.

A further object of the invention is to provide a simple, compact and versatile sheet manipulating apparatus whose operation can be automated to a desired extent.

An additional Object of the invention is to provide the apparatus with novel and improved means for simultaneously moving various tools through different distances and/or at different speeds.

SUMMARY OF THE INVENTION

The invention is embodied in an apparatus for manipulating sheet-like-products (e.g., products in the form of a series of non-overlapping or partially overlapping sheets of paper or the like or in the form of a web, i.e., a series of coherent sheets). The improved apparatus comprises means for transporting the products in a predetermined direction along a predetermined (e.g., at least substantially horizontal) path, tool positioning means including at least one movable holder which is adjacent the path, product engaging means including at least two tools (e.g., a rotary knife, a lateral aligning member, a front aligning member, an endless overhead belt conveyor and/or others) which are movable with and relative to the at least one holder, and means for preferably automatically adjusting the at least two tools relative to the path. The adjusting means comprises at least one guide (such guide can extend transversely of the path), a locating device, means for moving the locating device along the at least one guide relative to the path, and means separably coupling the locating device with at least one of the tools.

The coupling means can comprise means for selectively disconnecting the locating device from each of the at least two tools.

In accordance with a presently preferred embodiment, the coupling means comprises at least one distancing element and means for releasably connecting the at least one distancing element between the locating device and one of the tools to thus maintain the one tool at a predetermined distance from the locating device. The arrangement may be such that the coupling means comprises a distancing element for each of the at least two tools and each distancing element has a different length. Such coupling means further comprises means for releasably connecting the distancing elements between the locating device and the respective tools to thus maintain the at least two tools at different distances from the locating device. The locating device and the tools are movable to and from predetermined parking positions, and the connecting means comprises first connecting members which are movable with the distancing elements and complementary second connecting members which are movable with the locating device and each of which is engageable with and disengageable from one of the first connecting members. The lengths of the distancing elements are preferably such that the locating device and the tools can simultaneously assume the respective parking positions while the first connecting members are in engagement with the respective second connecting members. The tools can include a first group and a second group of tools, and the at least one guide preferably confines the locating device to movements in a preselected direction. The tools of the first group assume predetermined positions relative to a first reference plane in the parking positions of the tools of the first group, and the tools of the second group assume predetermined positions relative to a second reference plane in the parking positions of the tools of the Second group. The reference planes are normal to the preselected direction and all of the first connecting members are in engagement with or are engageable with the respective second connecting members when the locating device is maintained in the parking position and all of the tools also assume their respective parking positions.

The just outlined apparatus can further comprise a support which extends transversely of the predetermined path. The tools are movable along the support, one of the reference planes is disposed at one side of the predetermined path, and the other reference plane is located at least substantially midway between the one side and the other side of the predetermined path.

The apparatus can further comprise signal generating means for monitoring the positions of the tools, at least while the tools are out of the respective parking positions, and means for engaging the first connecting members with the respective second connecting members in response to signals from the corresponding monitoring means.

If the apparatus is to manipulate a web of coherent sheet-like products, the tools can include at least one cutter having means for dividing the web into a plurality of elongated strips which extend in the predetermined direction.

At least a portion of the guide can extend in the predetermined direction, and the at least two tools can be spaced apart from each other in the predetermined direction. The locating device of such apparatus is movable relative to the aforementioned portion of the at least one guide to move at least one of the at least two tools in the predetermined direction.

If the apparatus is designed to stack discrete sheet-like products at a stacking station which is adjacent the predetermined path, the transporting means preferably includes means for transporting at least one stream of successive discrete sheet-like products along the path to the stacking station. The tools of such apparatus can include at least one product guiding tool and at least one product orienting tool. The adjusting means of the apparatus is operative to automatically move the product guiding and orienting tools between a plurality of different positions to thereby conform the positions of the tools to different sizes of sheet-like products when the apparatus is to be set up to shift from stacking of products having a first size to stacking of products having a different second size. The at least one holder of such apparatus is or can be disposed at a level above the predetermined path and is elongated in the predetermined direction. The adjusting means includes means for shifting the at least one holder transversely of the predetermined path. The at least two tools are spaced apart from each other in the predetermined direction and can include a lateral guiding tool for the products in the path, a tool for flexing the products in the path and a depressing tool including a plurality of pulleys on the at least one holder and at least one endless belt which is trained over the pulleys. The tool positioning means of such apparatus can comprise a plurality of holders and the tools preferably include at least one tool for each holder. The tools can form at least one row which extends transversely of the predetermined path and the adjusting means can further comprise at least one common support for the at least one row of tools and means for moving the common support relative to the holders in the predetermined direction. The shifting means can include means for moving the holders back and forth relative to the common support. Such apparatus can further comprise a stationary track for each holder, and the holders are movable relative to the respective tracks in the predetermined direction. The adjusting means can comprise at least two common supports which extend transversely of the predetermined direction. The means for moving the supports in the predetermined direction can include means for moving the supports at different speeds and/or through different distances.

As mentioned hereinabove, the tools can include a plurality of product depressing tools each of which includes an endless flexible belt. A common rotary driving member can be provided for the belts, together with means for rotating the driving member and means for temporarily disengaging the belts from the driving member, at least during shifting of the at least one holder transversely of the predetermined path. The tool positioning means can comprise a plurality of shiftable holders and a stationary track for each of the holders. Each product depressing tool can be mounted on a discrete holder and each of the disengaging means can be provided on the track for the holder mounting the respective disengaging means. A stationary track can be provided for the at least one holder, and each product depressing tool can further comprise two pulleys on the track. Each belt is trained over the respective pulleys and the driving member is disposed between the pulleys of each pair of pulleys. Each depressing tool further comprises means for moving at least one of the respective pulleys relative to the driving member to loosen the respective blet at the driving member, and means for clamping the belt to at least one of the respective pulleys.

The product orienting tool can comprise a stop which is located in the predetermined path to intercept successive products of the at least one stream at the stacking station. The adjusting means comprises means for moving the orienting tool in and counter to the predetermined direction. At least one product depressing tool can be disposed above the predetermined path and can include a plurality of endless flexible belts having lower reaches which engage successive products of the at least one stream of discrete products. The belts are disposed in planes which extend in the predetermined direction and are normal to the path. The stop can comprise a plurality of spaced apart parallel elongated sheet arresting members (e.g., in the form of slats) which alternate with the lower reaches of the belts. The adjusting means of such apparatus further comprises a support which carries the stop and extends transversely of the predetermined path. The stop can further comprise means for lifting the arresting members above the path to permit movements of the belts transversely of the path. The lifting means can include means for maintaining selected arresting members at a level above the lower reaches of the belts. The maintaining means can comprise first detent members on the arresting members, second detent members adjacent the stop and each in register with at least one of the first detent members in the lifted positions of the respective arresting members, and means for engaging selected second detent members with the registering first detent members in the lifted positions of the respective arresting members. The arresting members are preferably mounted for gravitational descent into the predetermined path when released by the lifting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 11 is a fragmentary transverse vertical sectional view of a modified apparatus wherein the tools include two cutters for a running web of paper or the like;

DESCRIPTION OF PREFERRED EMBODIMENTS

Figure 1:
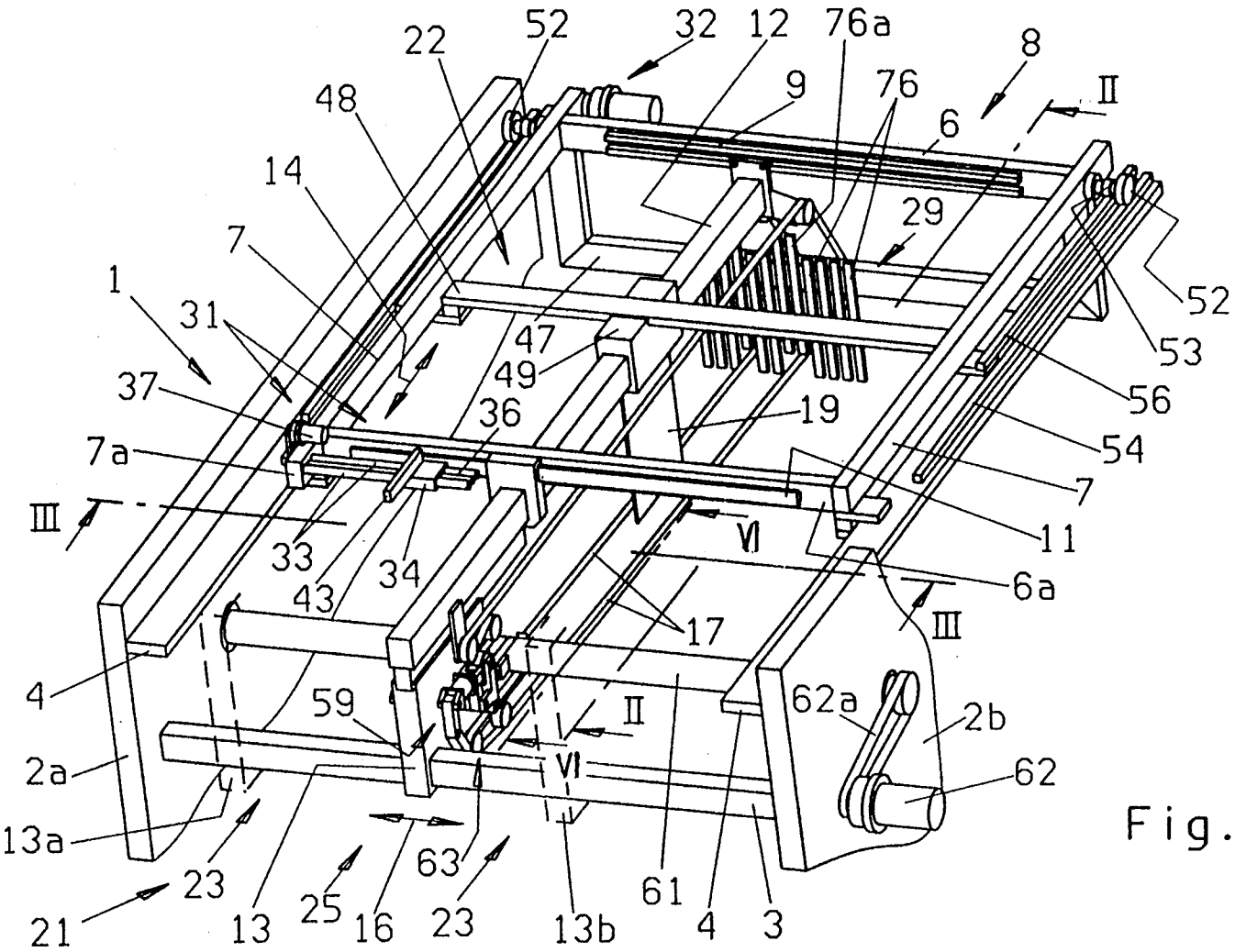
FIG. 1 is a perspective view of an apparatus which embodies one form of the invention and is used to gather one or more streams of discrete sheet-like products into stacks.
Figure 2:
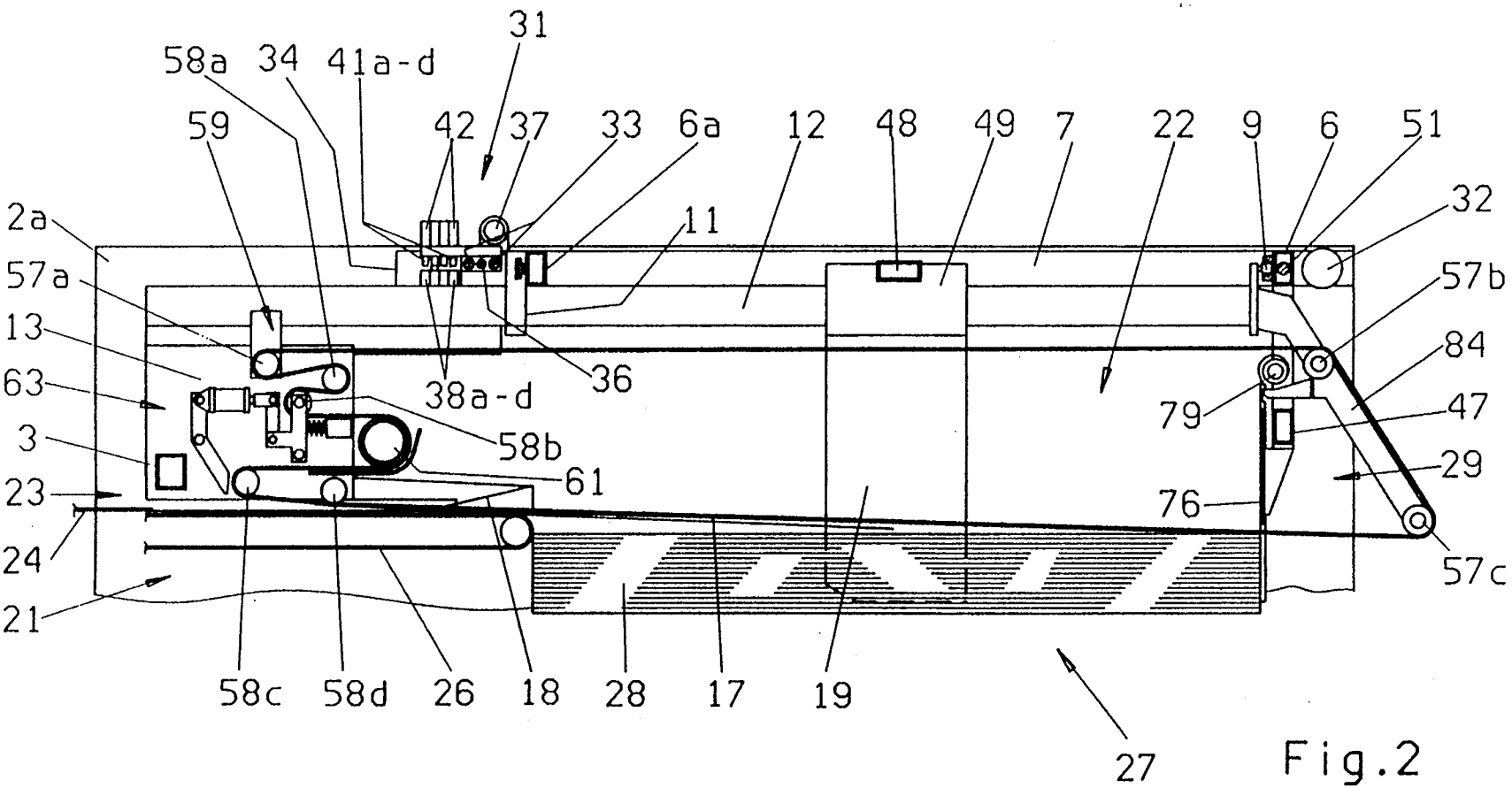
FIG. 2 is an enlarged longitudinal vertical sectional view substantially as seen in the direction of arrows from the line II—II in FIG. 1.

Referring to FIGS. 1.and 2, there is shown an apparatus which is designed to stack discrete sheet-like products 24 (hereinafter called sheets for short) at a stacking station 22. The apparatus comprises a frame 1 including sidewalls 2*a*, 2*b* and transverse frame members 3 (only one shown in FIGS. 1 and 2). The frame 1 supports horizontal or nearly horizontal tracks 4 for parallel supports 6, 6*a* which extend transversely of the direction (arrow 14) of advancement of successive sheets 24 toward and into the stacking station 22. The supports 6, 6*a* form part of a carriage 8 which further comprises connectors 7 serving to maintain the supports 6, 6*a* at a selected distance from each other and extending in the direction (arrow 14) of advancement of the sheets 24. The supports 6, 6*a* respectively carry elongated guides 9, 11 which extend transversely of the direction of transport of sheets 24 to the stacking station 22 and serve to guide one or more elongated bridges or holders 12 extending in the direction of arrow 14 and being movable sideways between the sidewalls 2*a*, 2*b* of the frame 1. The apparatus of FIGS. 1 and 2 is assumed to be provided with three parallel holders including the holder 12 which is actually shown and two additional holders which are parallel to and flank the illustrated holder. The illustrated holder 12 is movably mounted on a track 13, and the other two holders are movably mounted on two additional tracks 13*a*, 13*b* which are indicated in FIG. 1 by broken lines. The tracks 13, 13*a*, 13*b* and the holders (including the illustrated holder 12) are parallel to the sidewalls 2*a*, 2*b* and to the connectors 7 and extend at right angles to the supports 6 and 6*a*. The directions in which the holders 12 and the tracks 13–13*b* are reciprocable between the sidewalls 2*a*, 2*b* are indicated by a double-headed arrow 16. The tracks 13–13*b* are guided by the transverse frame members 3.

The purpose of the carriage 8 and of the parts which are mounted thereon is to support and select the positions of a plurality of product engaging tools. Such tools include at least one product depressing tool 17 having one or more endless flexible belts at a level above the horizontal or substantially horizontal path 25 for successive sheets 24, at least one product engaging and orienting tool 29 which serves as a stop for the sheets 24 arriving at the stacking station, at least one product flexing tool 18 which is located at a level above the path 25 (the same as the belts of the depressing tool 17), and at least one product engaging and aligning tool 19 which is adjacent one side of the path 25. The lower reaches of the belts of the depressing tool 17 are located at a preselected level to prevent at least the marginal portions of the sheets 24 from rising above the path 25 on their way toward the stacking station 22.

The means 21 for transporting sheets 24 to the station 22 (either in such a way that the leaders of the next-following sheets are located behind the trailing ends of the preceding sheets or in the form of a scalloped stream wherein the leader of each next-following sheet overlaps with the trailing end of the immediately preceding sheet) comprises at least one endless belt conveyor 26 having an upper reach which transports at least one stream of overlapping or non-overlapping sheets toward the station 22, i.e., toward engagement of the front edges of successive sheets with the tool or stop 29. The path 25 can comprise several sections 23, one for each of a number of discrete streams of sheets 24. Each section 23 of the path 25 is flanked by two lateral aligning tools 19, each section 23 is located beneath a depressing tool 17 including one or more endless belts, and each section 23 is located beneath two flexing tools 18, one for each longitudinal marginal portion of a sheet 24 in the respective section of the path 25.

The conveyor 26 Of the transporting unit 21 delivers one or more streams of non-overlapping or partially overlapping sheets 24 in the direction of arrow 14 toward the stop 29 which extends across the respective section 23 or across all sections of the path 25. If the apparatus defines a multiple-section path 25, the stacking station 22 comprises an equal number of substations or portions 27, one for each stream of sheets 24. FIG. 2 shows a single stack 28 of accurately overlapping sheets 24 which is immediately adjacent the stop 26 and is disposed between two lateral aligning tools 19 and beneath two flexing tools 18 and a depressing tool 17. The flexing tools 18 bend the marginal portions of successive sheets 24 out of the general planes of such sheets to thus enhance the rigidity of the sheets which ensures more predictable advancement along the path 25, i.e., on top of the immediately preceding sheets and beneath the belt or belts of the depressing tool 17. The flexing tools 18 are designed to flex the respective marginal portions of successive sheets 24 downwardly; such flexing enhances the predictability of advancement of sheets 24 between the respective pair of lateral aligning tools 19 toward and into contact with the vertically extending arresting members or slats 76 of the stop 29. The latter effects a final orientation of successive sheets 24 so that each overlapping sheet is in exact register with the sheet or sheets below it. The belt or belts of the depressing tool 17 prevent the sheets 24 from rising above the path 25 while the sheets are in the process of advancing between the lateral aligning tools 19 and beneath the flexing tools 18 toward the stop 29.

If the apparatus which is shown in FIGS. 1 and 2 is designed to simultaneously gather two neighboring stacks 28 of superimposed sheets 24, the median holder 12 (which is shown by solid lines) carries two depressing tools 17, one above each of the two sections 23 of the path 25. Furthermore, each of the non-illustrated holders on the outer tracks 13*a*, 13*b* carries a single depressing tool 17 (or no depressing tool at all if the two depressing tools on the illustrated holder 12 suffice to adequately hold the sheets 24 of two neighboring streams of sheets in the respective sections 23 of the path 25). Of course, if the apparatus is designed or modified to simultaneously gather three or more neighboring stacks 28, the holder on at least one of the tracks 13*a*, 13*b* also supports two overhead depressing tools 17. If the apparatus is to be converted for simultaneous gathering of four stacks 28 at the foremost ends of the respective sections 23 of the path 25, the holder on each of the two lateral tracks 13*a*, 13*b* also carries two depressing tools 17, and the apparatus then further comprises two additional tracks, one between the sidewall 2*a* and the track 13*a* and the other between the track 13*b* and the sidewall 2*b*. Each such additional track movably supports a holder for a single depressing tool 17. It is also possible to employ the apparatus of FIGS. 1 and 2 for the accumulation of a single stack 28 at a time. The holder on the track 13*a* or 13*b* is then idle, and the holder on the other of these tracks cooperates with the holder 12 on the track 13 to carry a requisite number of various tools which are necessary to properly flex, align and depress successive sheets 24 of a single stream of non-overlapping or partially overlapping sheets.

The apparatus of FIGS. 1 and 2 further comprises a transverse drive 31 which serves as a means for shifting the holder or holders 12 transversely of the path 25, i.e., sideways between the sidewalls 2*a* and 2*b* of the frame 1, and a longitudinal drive 32 which is used as a means for moving the carriage 8 in the direction of arrow 14, i.e., in or counter to the direction of transport of sheets 24 toward the stacking station 22. These two drives render it possible to rapidly change the format of the stacks 28, i.e., to accumulate stacks which consist of smaller or larger or wider or narrower sheets 24.

The transverse drive 31 is preferably designed in such a way that it can be utilized, without any or with minimal modifications, in other types of sheet manipulating machines, i.e., not only in apparatus which are designed to gather one or more stacks of superimposed sheets. The drive 31 renders it possible to change the mutual spacing and/or the positions of various tools transversely of the direction of advancement of sheets 24 toward the stacking station 22, i.e., in directions which are indicated by the double-headed arrow 16. The drives 31, 32 form part of an arrangement for automatically adjusting the tools 17, 18, 19 (and, if necessary, also the tool 29) relative to the path 25 and to thus change the setup of the apparatus preparatory to switching from the stacking of sheets 24 having a first format to the stacking of sheets having a different second format. The transverse drive 31 comprises a locating device 34 which is reciprocable along guide members 33 (hereinafter called rods for short) extending in the direction of arrow 16. The device 34 serves to select or alter the position(s) of the holder(s) 12 relative to the path 25 (namely, between the sidewalls 2*a*, 2*b* of the frame 1). The means for moving the locating device 34 along the rods 33 comprises a reversible electric motor 37 (see also FIGS. 3, 4 and 5) and a rotary feed screw 36 which is parallel to the rods 33 and can be rotated by the motor 37 in a clockwise direction or in a counterclockwise direction in order to move the device 34 in a direction from the sidewall 2*a* toward the sidewall 2*b* or in the opposite direction. The end portions of the rods 33 and feed screw 36 can be secured to and carried by the connectors 7 of the carriage 8, namely by extensions which form part of the connectors 7 and are located behind the support 6*a* (as considered in the direction of advancement of sheets 24 toward the stop 26). If the weight of the motor 37, feed screw 36, rods 33 and locating device 34 is not excessive, the feed screw 36 and/or the rods 33 can be mounted in overhung position on one of the connectors 7. FIGS. 1 and 3–5 show that one of the connectors 7 has a rearwardly projecting extension 7*a* which carries the motor 37, one end of the feed screw 36 and one end of each of the rods 33. Thus, the rods 33 and the feed screw 36 need not extend all the way between the two connectors 7, i.e., these parts need not extend all the way across the carriage 8.

Figure 3:
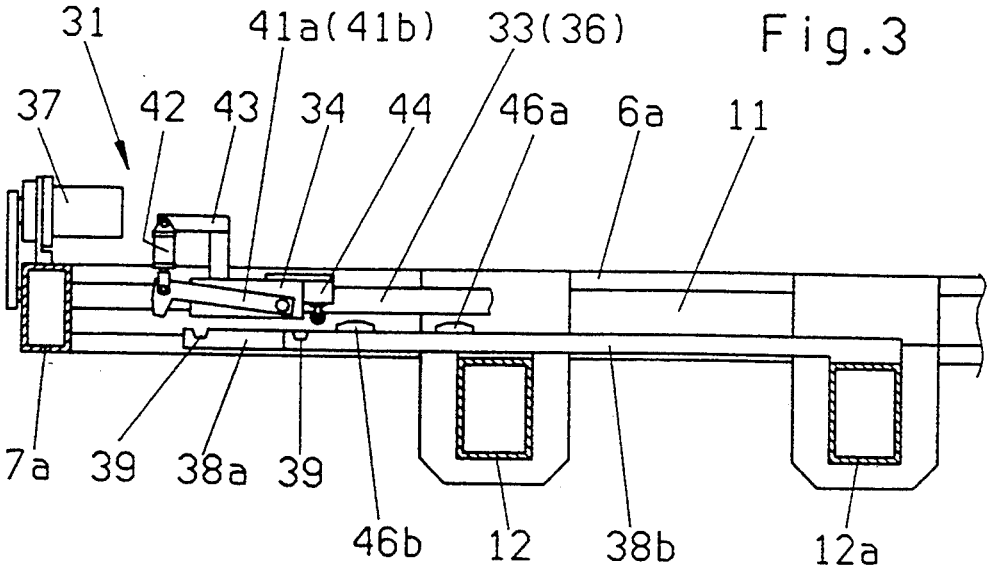
FIG. 3 is an enlarged fragmentary transverse vertical sectional view substantially as seen in the direction of arrows from the line III—III in FIG. 1.
Figure 4:
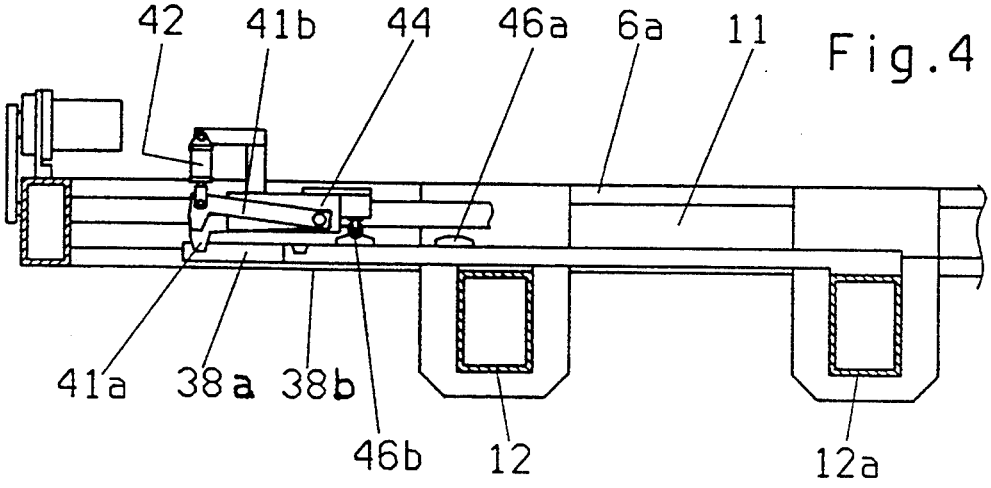
FIG. 4 illustrates the structure of FIG. 3 but with the locating device of the adjusting means in a different position in which the locating device is coupled with one of two tool holders.
Figure 5:
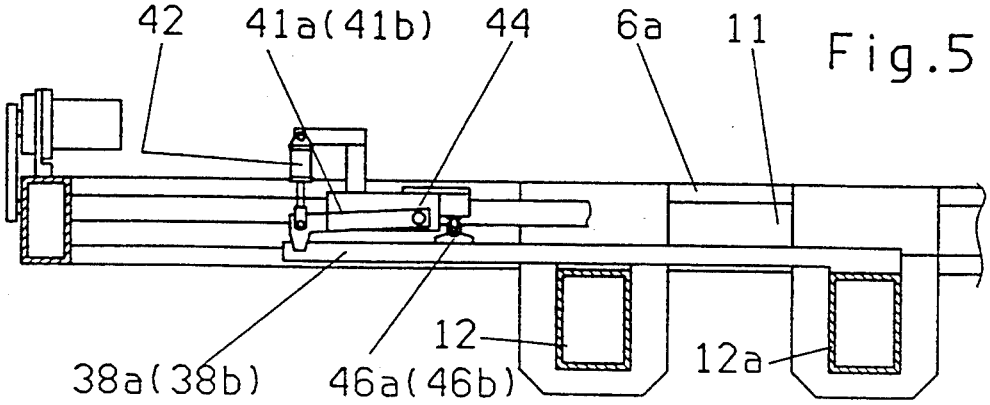
FIG. 5 illustrates the structure of FIG. 4 but with the locating device coupled to two tool holders.

The construction of the illustrated transverse drive 31 is such that it can adjust the holder or holders 12 all the way between the tracks 7 of the frame 1 in spite of the fact that neither the feed screw 36 nor the rods 33 extend all the way between the connectors 7. This is achieved in that the adjusting means for the tools 17, 18, 19 further comprises means for indirectly coupling the locating device 34 with one or more of these tools. The coupling means comprises one or more elongated distancing elements 38 in the form of bars or rods which extend in the direction of the arrow 16. At least one distancing element 38 is provided for each holder 12. FIGS. 3–5 show two distancing elements 38*a*, 38*b* because the apparatus embodying the structure of FIGS. 3 to 5 is assumed to utilize at least two holders 12, 12*a*. FIG. 2 shows four distancing elements 38*a*, 38*b*, 38*c*, 38*d*, i.e., the apparatus of FIG. 2 can comprise up to four holders (only the holder 12 is shown in FIG. 2) which enables the apparatus to simultaneously gather at least two stacks 28 of overlapping sheets 24.

The transverse drive 31 further comprises means for coupling the locating device 34 with the single distancing element, with both distancing elements of a set of two such distancing elements, or with at least two of a set of three or more distancing elements, depending upon the nature of adjustments which are to be carried out prior to switching from the stacking of sheets 24 having a first format to the stacking of sheets having a different second format. Actually, the means for coupling the locating device 34 with one or more distancing elements 38 can be said to constitute an arrangement for coupling the device 34 with one or more tools 17, 18, 19 in such a way that the connection can be established or terminated with little loss in time. The coupling means comprises female coupling or detent members 39 including recesses or sockets which are provided in the distancing elements 38, male coupling or detent members 41 in the form of pawls which are mounted on the locating device 34, and fluid operated (e.g., pneumatic) cylinder and piston units 42 mounted on arms 43 of the device 34 and being actuatable in response to suitable signals to engage the male detent members 41 with or to disengage such male detent members from the registering female detent members 39. The female detent members 39 of the distancing elements 38 are adjacent the path of movement of the locating device 34 along the rods 33. The locating device 34 is movable along the rods 33 in the directions of arrow 16, i.e., toward and away from the observer of FIG. 2.

When the adjustment of the tools 17, 18, 19 for the gathering of sheets 24 having a particular format is completed, the cylinder and piston units 42 maintain the respective male detent members 41 in disengaged (raised) positions, i.e., above and away from the sockets of the respective female detent members 39. FIG. 2 shows four detent members 41*a*, 41*b*, 41*c*, 41*d* in disengaged positions (i.e., lifted above and away from the female detent members 39 in the respective distancing elements 38*a*, 38*b*, 38*c*, 38*d*), and FIGS. 3 and 4 also show the detent members (41*a*, 41*b*) in the raised or disengaged positions (above and away from the detent members 39 in the respective distancing elements 38*a*, 38*b* which are rigid with the holders 12 and 12*a*).

The apparatus further comprises signal generating monitoring devices or sensors 44 which serve to transmit signals to the cylinder and piston units 42 in order to effect engagement of the detent members 41 and/or to effect disengagement of the detent members 41 from the respective female detent members 39. The sensors 44 can be actuated by trips 46 (FIGS. 3 to 5 show two trips 46*a*, 46*b*) which are provided on the respective distancing elements 38 and cause the sensors to generate signals when the respective male detent members 41 are accurately aligned with the adjacent female detent members 39 so that the pallets of the male detent members can penetrate into the respective sockets. Each of the illustrated sensors 44 is assumed to constitute a mechanical sensor. However, it is equally within the purview of the invention to employ sensors in the form of proximity detectors, photoelectronic transducers and/or other means Which can generate signals for actuation of the cylinder and piston units 42 or other suitable means for engaging the male detent members 41 With and/or for disengaging these detent members from the registering female detent members 39.

In order to adjust the positions of the holders 12, 12*a* which are shown in FIGS. 3 to 5 (and hence the positions of tools which share the movements of these holders), the locating device 34 is moved along the rods 33 (with the male detent members 41*a*, 41*b* disengaged from the respective female detent members 39) from a starting position (FIG. 3) transversely of the path 25 in a direction to the right until the sensor 44 on the distancing element 38*a* indicates that the detent member 41*a* has been moved to a position of register with the socket of the female detent element 39 on the distancing element 38*a*. This is shown in FIG. 4. The signal from the sensor 44 on the distancing element 38*a* causes the respective cylinder and piston unit 42 to engage the detent member 41*a* with the adjacent detent member 39 so that the holder 12 (and each tool on this holder) is releasably coupled to the locating device 34.

The motor 37 thereupon causes the feed screw 36 to again advance the locating device 34 along the rods 33 (from the position of FIG. 4 to the parking position of FIG. 5) so that the male detent member 41*b* on the device 34 is aligned with the socket of the female detent member 39 on the distancing element 38*b* which is affixed to the holder 12*a*. The sensor 44 on the locating device 34 is then engaged by the actuator or trip 46*b* on the distancing element 38*b* and causes the corresponding unit 42 to engage the detent member 41*b* with the respective female detent member 39 so that the locating device 34 is coupled with the holder 12*a* and with each tool on this holder. The holder 12 shares the movements of the locating device 34 along the rods 33 as soon as the detent member 41*a* is coupled with the aligned female detent member 39 (on the distancing element 38*a*), and the holder 12*a* shares all movements of the locating device 34 as soon as the male detent member 41*b* is coupled with the aligned female detent member 39 (on the distancing element 38*b*).

The locating device 34 is thereupon moved by the motor 37 in accordance with a preselected program in order to move the holders 12 and 12*a* to preselected positions relative to the path 25, i.e., to positions at predetermined distances from the sidewalls 2*a*, 2*b* of the frame 1. The cylinder and piston unit 42 for the male detent member 41*a* is caused to disengage this detent member from the respective female detent member 39 when the holder 12 reaches the selected position, and the cylinder and piston unit 42 for the male detent member 41*b* disengages this detent member from the respective female detent member 39 when the holder 12*a* reaches the selected position between the sidewalls 2*a*, 2*b*. The distancing element 38*a* can be disengaged from the locating device 34 prior to disengagement of the device 34 from the distancing element 38B or vice versa.

The just described construction and mode of operation of the adjusting means including the locating device 34 exhibit the advantage that the device 34 must cover relatively short distances (compare the positions of the device 34 in FIGS. 3, 4 and 5) in order to change the positions of the holders 12, 12*a* relative to each other and relative to the path 25 (as seen in the direction of arrow 16). Thus, the locating device 34 can be mounted for movement through one-half of the distance between the sidewalls 2*a*, 2*b* in order to move the holders 12, 12*a* to any desired position or positions between such sidewalls. All that is necessary is to properly select the effective length of the distancing elements 38, i.e., the distances of the female detent members 39 from the respective holders. The just discussed feature of the adjusting means including the locating device 34 is particularly important and advantageous if one side of the frame and the longitudinally extending central vertical symmetry plane of the apparatus are defined as reference planes for movement of the two holders 12, 12*a* from parking positions to selected positions. If the holders 12, 12*a* are moved to their parking positions in predetermined relationship to their corresponding reference planes, and the locating device 34 is also moved to its parking position in a predetermined relationship to both reference planes, the pallets of all of the male detent members 41 are in register with the sockets of the respective female detent members 39. Thus, all of the cylinder and piston units 42 can be actuated simultaneously to engage the male detent members 41 with the respective female detent members 39 preparatory to shifting of all of the holders relative to the sidewalls 2*a* and 2*b*. Successive holders are thereupon uncoupled from the locating device 34 (i.e., the latter is uncoupled from the respective distancing elements 38) as soon as the respective holders reach their newly selected positions.

In the embodiments which are shown in the drawings, the distancing elements 38*a*, 38*b* or 38*a* to 38*d* are affixed to the respective holders (such as the holders 12, 12*a* of FIGS. 3 to 5). This is desirable and advantageous because it contributes to simplicity and compactness of the improved apparatus. However, it is equally within the purview of the invention to mount the distancing elements 38 on the locating device 34 and to employ cooperating male and female detent members (or other suitable means) for releasably connecting the distancing elements of the locating device with the respective holders for various sheet engaging tools.

As a rule, a change of setup necessitates, or is likely to necessitate, an adjustment of the positions of some or all of the sheet engaging tools in directions which are indicated by the arrow 16 (i.e., transversely of the path 25) as well as in or counter to the direction of transport of sheets 24 toward the stacking station 22 (i.e., in directions which are indicated by the arrow 14). The tools 17, 18, 19, 29 are (or can be) spaced apart from each other in the direction of advancement of sheets 24 toward the stacking station 22. The sheet flexing tools 18 can be fixedly secured to the guides 13 which are movable along the stationary frame members 3. The flexing tools 18 are adjacent the discharge end(s) of the conveyor or conveyors 26 of the transporting unit 21 to engage and flex the respective marginal portions of the oncoming sheets 24 as soon as possible, i.e., preferably at a reasonable distance from the stop 29. This ensures that the sheets 24 which advance from the conveyor or conveyors 26 toward the stop 29 are reasonably stiff and, accordingly, are more likely to be stacked in optimum positions relative to the sheets below them.

The position of each stop 29 is determined by (i.e., is dependent from) the length of the sheets 24. Otherwise stated, the distance of a stop 29 from the conveyor or conveyors 26 of the transporting unit 21 depends on the length of the sheets 24 which are to be stacked in the corresponding portion 27 of the station 22, i.e., which are delivered in the corresponding section 23 of the path 25. The stop 29 which is shown in FIGS. 1 and 2 is mounted on a bridge 47 which can form an integral or a separable part of the support 6, i.e., of that support which is nearer to the front end of the frame 1. As already explained hereinabove, the supports 6, 6*a* and the connectors 7 form a carriage 8 which can move the holder (12) or holders (12, 12*a*) in and counter to the direction of transport of sheets 24 toward the stacking station 22. The connectors 7 and/or the respective end portions of the supports 6, 6*a* are reciprocable along the tracks 4 of the frame 1. Since the flexing tools 18 are mounted on the track(s) (13, 13*a*, 13*b*) for the holder or holders, they do not share the movements of the carriage 8 in directions which are indicated by the arrow 14, i.e., the tools 18 can be adjusted only by moving the respective tracks 13, 13*a*, 13*b* along the transverse frame members 3.

The lateral aligning tools 19 are affixed to the respective holders (note the holder 12 in FIGS. 1 and 2) and, therefore, these tools can be moved in directions which are indicated by the arrow 14 and/or in directions which are indicated by the arrow 16. The tool 19 of FIGS. 1 and 2 is movable along a further support or crossbeam 48 which is disposed between the connectors 7 and extends transversely of the path 25. The crossbeam 48 supports a slide 49 which carries the tool 19 and is movable along this crossbeam in response to movement of the holder 12 under the action of the motor 37, feed screw 36, locating device 34 and the respective distancing element 38 (while the distancing element 38 is coupled to the device 34 by the detent members 39, 41).

The arrangement may be such that the end portions of the crossbeam 48 are slidable along the respective connectors 7 and/or along the adjacent tracks 4, i.e., the crossbeam 48 is then movable relative to the carriage 8 in a direction from the support 6 toward the support 6*a* or in the opposite direction.

The longitudinal moving means or drive 32 serves to move the carriage 8 in directions which are indicated by the double-headed arrow 14. This drive includes a reversible electric motor (Dr an analogous prime mover) which can rotate a shaft 51 (note FIG. 2) through a belt or chain transmission (not shown). The shaft 51 is parallel to the holders 6, 6*a* and is mounted in the carriage 8, the same as the motor of the drive 32. Each end portion of the shaft 51 carries two gears 52, 53. The gears 52 mate with elongated toothed racks 54 which are affixed to the frame 1 (e.g., to the respective tracks 4) and extend in the direction of advancement of sheets 24 toward the stacking station 22. The motor of the drive 32 is set up to rotate the shaft 51 (and hence the gears 52) at a predetermined speed which results in movement of the carriage 8 at a corresponding speed along the tracks 4.

The numbers of teeth and the diameters of the gears 52, 53 are selected in such a way that the speed of the crossbeam 48 relative to the frame 1 departs from the speed of the carriage 8 when the motor of the drive 32 is on to rotate the shaft 51. The gears 53 mate with elongated toothed racks 56 which are fixedly connected with the respective ends of the crossbeam 48. The racks 56 are movable with the crossbeam 48 in directions which are indicated by the arrow 14, and such movements take place relative to the carriage 8. Thus, when the motor of the drive 32 is on, the gears 52 cooperate with the stationary toothed racks 54 to move the carriage 8 relative to the frame 1, and the gears 53 cooperate with the mobile toothed racks 56 to move the crossbeam 48, the slide 49 and the lateral aligning tool 19 relative to the frame 1 as well as relative to the carriage 8. The extent of movement of the tool 19 relative to the carriage 8 (in response to rotation of the shaft 51) depends upon the distance which is covered by the carriage 8 relative to the frame 1 as well as upon the difference between the ratios of the transmissions 52, 54 and 53, 56. The transmission ratio can be selected in such a way that the distance which is covered by the tool 19 in one of the directions indicated by the arrow 14 is approximately or exactly half the distance which is covered by the carriage 8 in the same direction. This ensures that the tool 19 is invariably located substantially or exactly midway between the flexing tools 18 and the stop 29 for the respective stream of sheets 24. Such positioning of the tool 19 has been found to be quite satisfactory for proper alignment and orientation of sheets 24 which are caused to advance along the respective section 23 of the path 25.

The depressing tools 17 are mounted on and share the movements of the respective holders in directions which are indicated by the arrow 14. This ensures that the lower reaches of stretches of the tools 17 invariably maintain the adjacent sheets 24 in their path 25 while the sheets are being transported toward the (respective) stop 29. This holds true regardless of the positioning of the stop 29, i.e., regardless of the selected distance of the stop 29 from the conveyor or conveyors 26 of the transporting unit 21. In other words, the feature that the depressing tool or tools 17 are movable with the (respective) holder or holders suffices to ensure that the sheets 24 are confined to movement at a predetermined level regardless of the format of such sheets.

Figure 6:
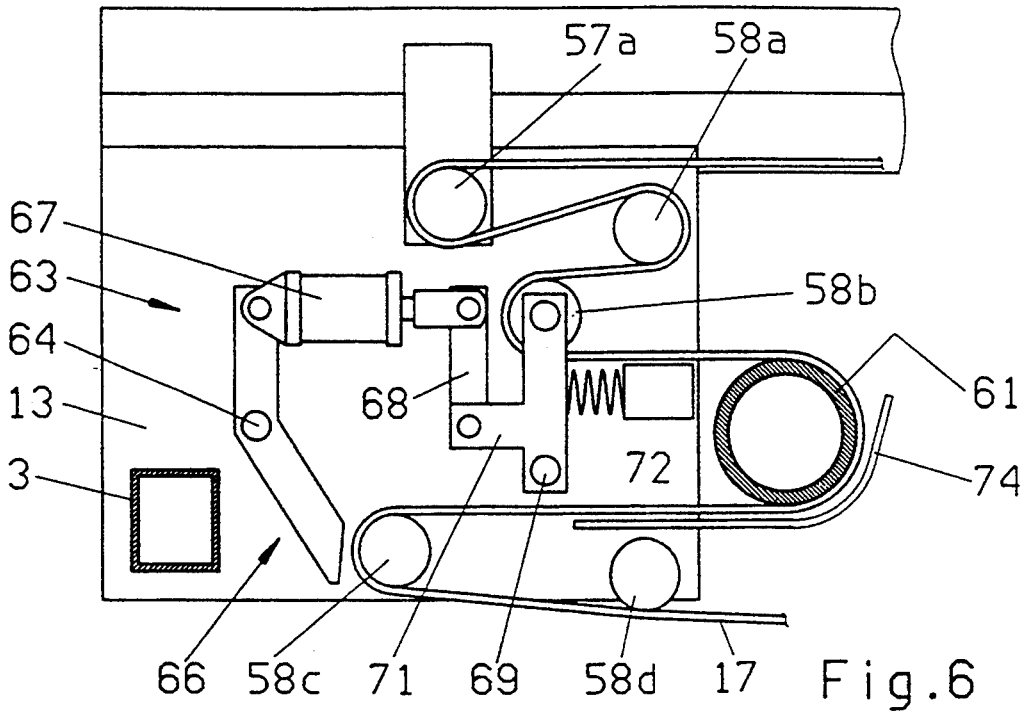
FIG. 6 is an enlarged fragmentary longitudinal vertical sectional view substantially as seen in the direction of arrows from the line VI—VI in FIG. 1 and shows a belt of a product depressing tool in the Operative position.
Figure 7:
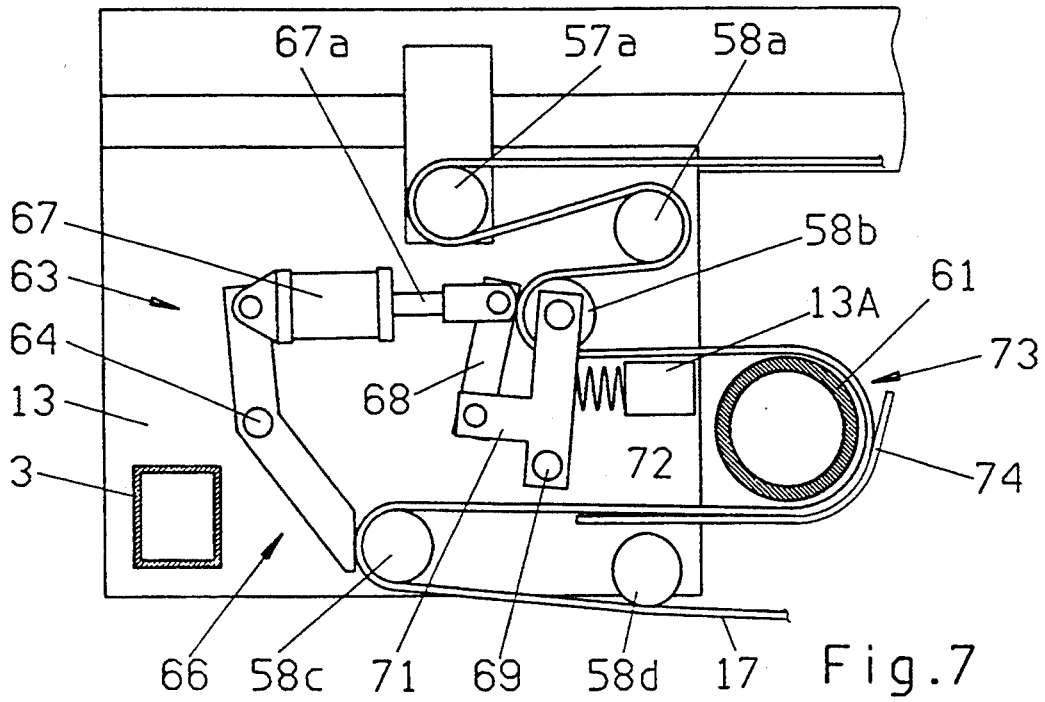
FIG. 7 illustrates the structure of FIG. 6 but with the belt disengaged from a rotary driving member.

The belt or belts of each depressing tool 17 are trained over a first set of pulleys 57*a*, 57*b*, 57*c* which are rotatably mounted on the holder 12 (see particularly FIGS. 2, 6 and 7). The belt or belts of the depressing tool 17 are further trained over pulleys 58*a*, 58*b*, 58*c*, 58*d* which are mounted on the track 13 shown in FIGS. 2, 6 and 7. Thus, the pulleys 57*a*–57*c* can move with the holder 12 in directions which are indicated by the arrows 14 and 16 whereas the pulleys 58*a*–58*d* can move only in directions which are indicated by the arrow 16. The pulleys 57*a*–57*c* and 58*a*–58*d* cooperate to form a magazine 59 which can store a length of the belt or belts forming part of the depressing tool 17. This compensates for changes of the effective length of each such belt in response to movements of the carriage 8 along the tracks 4 of the frame 1. The arrangement is preferably such that the effective length of each belt forming part of the depressing tool 17 is altered in automatic response to each change of setup of the improved apparatus to prepare the apparatus for the stacking of sheets 24 having a size and/or shape other than that of the previously manipulated sheets. Thus, it is not necessary to manually adjust the effective length of the belt or belts forming part of a depressing tool 17 when the setup of the apparatus is to be changed. This entails considerable reductions in down times and contributes to higher output of the apparatus.

FIGS. 1, 2, 6 and 7 show a single rotary driving member 61 in the form of an elongated roller which engages and rives all belts of the illustrated depressing tool 17. The end portions of the driving member 61 are rotatably journalled in the sidewalls 2*a*, 2*b* of the frame 1, and the sidewall 2*b* carries an electric motor 62 or another suitable prime mover which can rotate the driving member 61 at a single speed or at one of a plurality of different speeds.

In order to avoid problems during shifting of the holder or holders for the tool or tools 17 in directions which are indicated by the arrow 16, the apparatus preferably comprises means (shown at 63) for temporarily disengaging the belt or belts of each tool 17 from the driving member 61. The disengaging means 63 is designed to temporarily disengage the belt or belts of each tool 17 from the driving member 61 and to simultaneously clamp each disengaged belt to the respective pulleys 58*b*, 58*c* on the corresponding track (note the track 13 of FIGS. 6 and 7). This even more reliably ensures that the belts of each tool 17 are compelled to share the movements of the holder (12) and track (13) along the frame members 3, i.e., in one of the directions which are indicated by the arrow 16.

The disengaging means 63 which is shown in FIGS. 6 and 7 comprises a bell crank lever 66 which is pivotable about the axis of a shaft 64 mounted in the track 13 and extending transversely of the path 25. The upper arm of the lever 66 carries a cylinder and piston unit 67 (e.g., a pneumatically operated unit) having a piston rod 67*a* which is articulately connected with one end portion of a link 68. The other end portion of the link 68 is articuately connected to and can pivot an arm 71 which is pivoted to the track 13 (as at 69) and carries the pulley 58*b*. The other arm of the bell crank lever 66 can engage and clamp or grip that portion of the illustrated belt of the depressing tool 17 of FIGS. 6 and 7 which is trained over the pulley 58*c*. The upper end portion of the link 68 can engage and clamp or grip that portion of the belt of the tool 17 which is trained over the pulley 58*b*, The arm 71 is biased in a counterclockwise direction (as viewed in FIGS. 6 and 7) by a coil spring 72 which reacts against an abutment 13A on the track 13.

When the cylinder and piston unit 67 receives a signal to move the piston rod 67*a* outwardly, the upper end of the link 68 is caused to engage the belt or belts of the tool 17 at the pulley 58*b*, and the lower arm of the lever 66 is caused to engage the belt or belts at the pulley 58*c*. Thus, the belt or belts of the tool 17 are simultaneously clamped against the peripheral surfaces of the pulleys 58*b* and 58*c*. As the piston rod 67*a* moves outwardly (from the position of FIG. 6 toward the position of FIG. 7), it causes the arm 71 to pivot in a clockwise direction against the opposition of the coil spring 72 whereby the belt or belts of the tool 17 are disengaged from the driving member 61 so that the tool 17 can be readily moved (with the holder 12 and track 13) along the transverse frame members 3 from the sidewall 2*a* toward the sidewall 2*b* or in the opposite direction. The belt or belts of the tool 17 then form one or more loops 73 (FIG. 7) which bear against an intercepting device or catcher 74 on the track 13; the device 74 maintains the loop 73 in a state of readiness for reengagement with the driving member 61 as soon as the spring 72 is free to dissipate energy (i.e., as soon as the piston rod 67*a* is retracted into the cylinder of the unit 67) so that the member 61 can again drive the belt or belts when the tool 17 is to prevent successive sheets 24 from rising above the optimum level during advancement along the respective section 23 of the path 25. The intercepting device 74 can constitute a suitably bent piece of metallic sheet material or a piece of plastic material. The cylinder and piston unit 67 can be actuated in response to starting of the motor 37 and remains operative as long as necessary to ensure that the holder 12 and the associated track 13 reach their newly selected positions, i.e., at selected distances from the sidewalls 2*a* and 2*b*. The piston rod 67*a* is then retracted into the cylinder of the unit 67 so that the link 68 is disengaged from the belt of the tool 17 at the pulley 58*b* and the lower arm of the bell crank lever 66 is disengaged from such belt at the pulley 58*c*. Suitable abutments (not specifically shown) can be provided to maintain the link 68, the arm 71 and the bell crank lever 66 in their respective idle or retracted positions which the member 61 is free to drive the belt or belts of the tool 17 and to thus rotate the pulleys 58*b* and 58*c*. The disengaging means 63 can further comprise springs or other suitable means for biasing the lever 66, the arm 71 and the link 68 to their respective retracted or inoperative positions.

The disengaging means 63 can be modified in a number of ways, or can be replaced by a different disengaging means, without departing from the spirit of the invention. All that counts is to ensure that the driving member 61 cannot interfere with predictable movements of the belt or belts of the tool or tools 17 in directions which are indicated by the arrow 16 when the apparatus is to be set up for the treatment of sheets having different formats.

Figure 8:
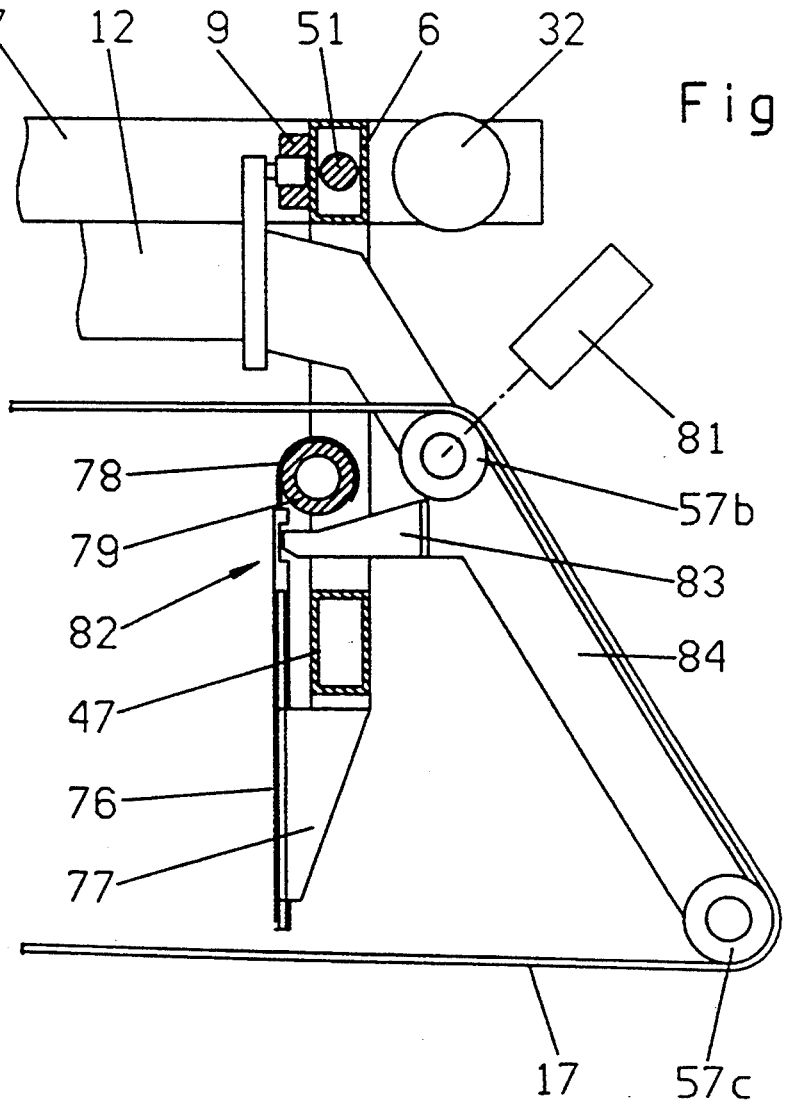
FIG. 8 is an enlarged view of a detail in the right-hand portion of FIG. 2.
Figure 9:
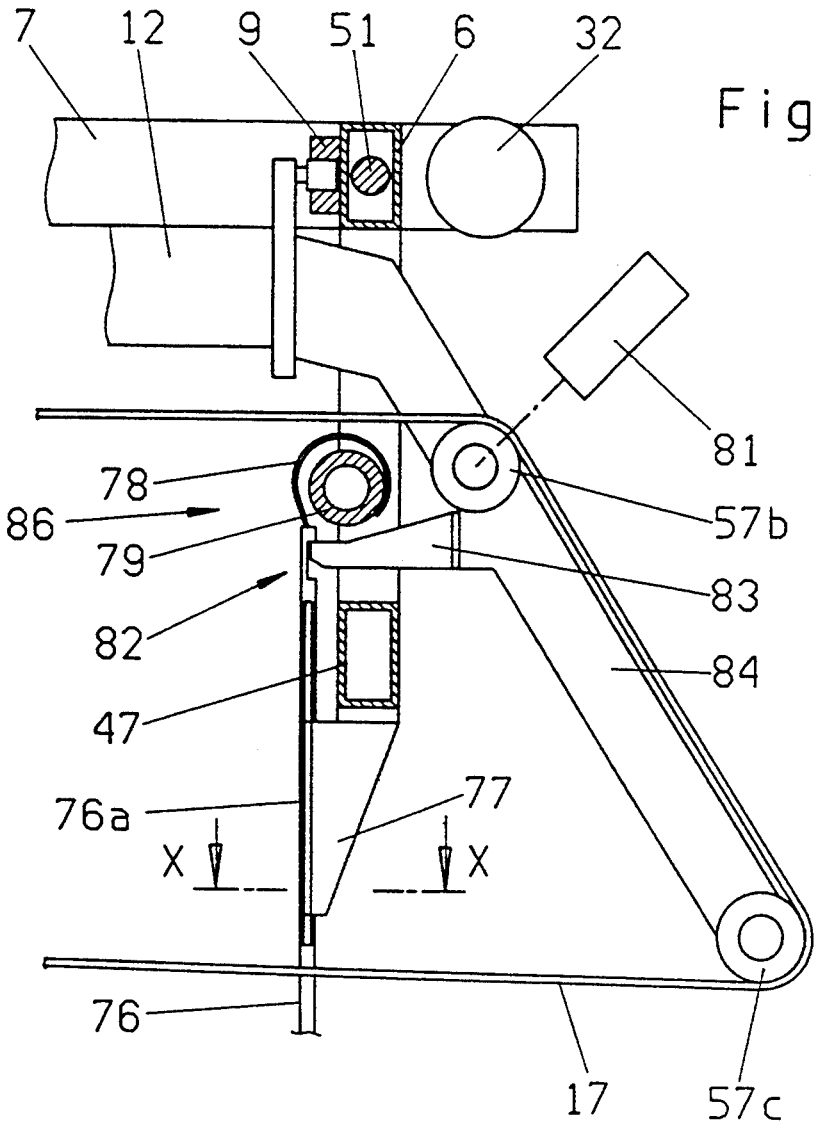
FIG. 9 illustrates the structure of FIG. 8 but with certain arresting members of a stop for sheet-like products at a different level.
Figure 10:
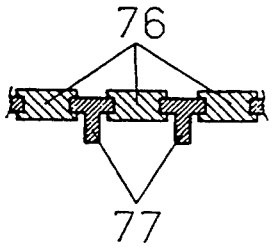
FIG. 10 is an enlarged fragmentary horizontal sectional view substantially as seen in the direction of arrows from the line X—X in FIG. 9.

FIG. 1 shows that the stop 29 comprises a substantial number of vertical or nearly vertical arresting members 76 in the form of slats whose lower end portions extend to a level below the lower reach(es) or stretch(es) of the belt or belts forming part of the corresponding depressing tool or tools 17. These arresting members are vertically movably mounted on the bridge 47 of the support 6. The bridge 47 is provided with guides 77 (see also FIG. 10) which define vertical or nearly vertical paths for the respective arresting members 76 of the stop 29. The guides 77 are installed at a level above the lower reach or reaches of the belt or belts forming part of the tool 17 which is shown in FIGS. 8 and 9. The upper end portions of the arresting members 76 are affixed to discrete flexible bands or straps 78 forming part of a device for lifting and lowering the arresting members. Lifting of the arresting members 76 is necessary if the stop 29 is to be moved toward the sidewall 2*a* or 2*b* while the holder 12 is maintained at a standstill (as seen in the directions which are indicated by the arrow 16). The lifting device further comprises a roller 79 which is connected to the other end of each strap 78. The roller 79 is rotatably supported by the bridge 47 and can be rotated by a reversible motor or another suitable prime mover 81 (shown schematically in FIGS. 8 and 9). If the roller 79 is rotated in a clockwise direction as seen in FIG. 8 or 9), the straps 78 are convoluted onto its peripheral surface and the arresting members 76 are lifted from the positions of FIG. 9 to the positions of FIG. 8 (i.e., the lower end portions of the members 76 are lifted from a level below to a level above the lower reach(es) of the belt(s) forming part of the adjacent depressing tool(s) 17. If the roller 79 is driven to rotate in a counterclockwise direction (again as seen in FIGS. 8 and 9), the arresting members 76 are permitted to descend by gravity and to reenter the path 25 to arrest successive oncoming sheets 24 in optimum positions for the gathering of a satisfactory stack 28 wherein each sheet is in exact alignment with the sheets above and below it.

In order to ensure that selected arresting members 76*a* can be maintained in raised positions while the remaining arresting members 76 are free to descend by gravity, the apparatus further comprises suitable means for preventing gravitational descent of such selected arresting members. To this end, the rear sides of all arresting members 76 are provided with female detent members 82 having sockets for reception of the working ends of complementary male detent members 83 on an arm 84 which is provided on the holder 12. All female detent members 82 are located at the same level when all of the arresting members 76 assume their upper end positions or their lower end positions. The arms 84 carry the pulleys 57*b*, 57*c* for the belt or belts of the depressing tool 17 which is shown in FIGS. 8 and 9. This contributes to simplicity and compactness of the tool or stop 29.

Prior to shifting of the track 13 and holder 12 in FIGS. 8 and 9 along the transverse frame members 3 of the frame 1, the prime mover 81 is started to rotate the roller 79 in a clockwise direction and to thus cause the straps 78 to lift the corresponding arresting members 76 to the level of the arresting member which is shown in FIG. 8. This ensures that the lower end portions of the arresting members 76 no longer extend downwardly beyond the lower reach or reaches of the belt or belts of the tool 17 so that the latter can move with the holder 12 in response to actuation of the motor 37 for the locating device 34 which is then coupled to the holder 12, i.e., to the tool 17. The female detent members 82 on all arresting members 76 are then located at the same level and are properly positioned for reception of the working ends of the respective male detent members 83. Once the members 83 engage the adjacent members 82, the respective arresting members 76 are located between the upper and lower reaches of the belt or belts of the tool 17 so that the latter is free to move with the holder in directions toward and away from the observer of FIGS. 8 and 9. Such positions of the male detent members 83 correspond to that of the member 83 which is shown in FIG. 8.

When the holder 12 of FIGS. 8 and 9 reaches a desired position in response to movement of the locating device 34 along the guide rods 33, the prime mover 81 is operated to turn the roller 79 in a counterclockwise direction so that the straps 78 permit the arresting members 76 to descend by gravity and to assume the positions which are shown in FIG. 9, i.e., the lower end portions of the arresting members 76 extend to a level below the lower reach or reaches of the belt or belts of the tool 17 and into the path 25 for the sheets 24. However, the arresting members **76*a* (FIGS. 1 and 9) are held in the raised positions by the respective male detent members 83 because such arresting members are in vertical alignment with the lower reaches of the respective belts forming part of the tool 17. This prevents the arresting members 76*a* from interfering with movements of the adjacent belt or belts of the tool 17. The remaining arresting members 76 which were permitted to descend by gravity suffice to ensure that successive sheets 24 are arrested in optimum positions for the building of a satisfactory stack 28 at the front end of the respective section 23 of the path 25**.

The number of male detent members 83 need not match the number of female detent members 82. The arrangement may be such that a single male detent member 83 can enter two or more neighboring female detent members 82. In other words, a single male detent member 83 can maintain two or more neighboring arresting members **76*a* in raised or inoperative positions. It is further possible to reverse the positions of the male and female detent members 83 and 82**.

The reference character 86 denotes in FIG. 9 a loop which is formed by the strap 78 in response to rotation of the roller 79 in a counterclockwise direction while the male detent member 83 extends into the socket of the aligned female detent member 82.

A Change of setup is completed when some or all of the tools 17, 18, 19, 29 are adjusted in a direction transversely of the path 25 and when some or all of the tools are adjusted in or counter to the direction of transport of sheets 24 toward the stacking station 22. Movements of some or all of the tools in one of the directions which are indicated by the arrow 16 involve movements with the holder(s) 12 and track(s) 13 along the frame members 3 under the action of adjusting means including the locating device 34 which is then coupled to some or all of the tools by being coupled to the distancing element(s) 38 of the holder(s) 12. Such adjustments of the holder(s) and track(s) along the frame members 3 take place subsequent to lifting of arresting members 76 forming part of the stop(s) 29 to a level as shown in FIG. 8, i.e., above the lower reach(es) of the belt(s) forming part of the tool 17. The locating device 34 is then moved along the rods 33 under the action of the motor 37 and feed screw 36 in order to couple this locating device with each holder which is to be moved to a different position by moving along the frame members 3. Movements of the locating device 34 along the rods 33 are interrupted in response to signals from the sensors 44 (it being assumed that this locating device is to change the positions of two or more holders (such as the holders 12, **12*a* of FIGS. 3 to 5). As already described hereinbefore, the sensors 44 transmit signals to the respective cylinder and piston units 42 when the male detent members 41 move into alignment With the respective female detent members 39 so that the locating device 34 can be properly coupled to the respective distancing elements 38. Once the locating device 34 is coupled with a distancing element 38, the respective holder shares the movements of the device 34 while the latter is in the process of moving to an optimum position for coupling with the remaining holder or holders which are to be moved along the frame members 3. The operation of the motor 37 can be programmed so that coupling of the locating device 34 with one or more distancing elements and the transport of the thus coupled distancing element or elements (and of the corresponding holder or holders) to different position or positions is carried out in a fully automatic way and within a shortest possible interval of time to thus ensure that the apparatus is ready for the manipulation of sheets having a different format. Furthermore, the arrangement may be such that the locating device 34 is caused to engage a first distancing element 38, to transport the corresponding holder to a newly selected position, to be disengaged from the first distancing element, to move to a position of engagement with a second distancing element, to move the corresponding holder to a newly selected position, and so forth. In other words, it is not necessary to couple the locating device 34 with all of the holders which are to be moved to different positions (in one of the directions which are indicated by the arrow 16) before the device 34 begins to move the thus coupled holder or holders to the newly selected position(s). It is presently preferred to operate the device 34 in such a way that it is coupled with all of the holders (which are to be shifted to new positions) in a first step and to thereupon move the holders to newly selected positions in a sequence such that the change of setup is completed within the shortest possible interval of time. The distancing elements 38 render it possible to move several holders to any one of a number of different positions all the way between the sidewalls 2*a* and 2*b* of the frame 1**. This contributes to savings in time for a change of setup. Furthermore, each holder can be moved to a newly selected position with a high degree of predictability and reproducibility. Still further, the holder or holders must cover minimal distances on their way to the newly selected positions so that the wear upon the parts which must be moved relative to each other in order to move the holders to newly selected positions is minimal.

The disengaging means 63 is operative during movement of the holder or holders along the frame members 3 but is rendered inoperative when the shifting of one or more holders to the new position or positions is completed. This ensures that the common driving member 61 for the belt or belts of the tool or tools 17 cannot interfere with movements of such belt or belts in a direction from the sidewall 2*a* toward the sidewall 2*b* or in the opposite direction. Also, the arresting members 76 of the stop or stops 29 are permitted to descend by gravity so that they are in optimum positions to intercept the oncoming sheets 24 for the gathering of one or more stacks 28 at the station 22.

The longitudinal drive 32 is set in operation in order to move some or all of the tools in or counter to the directions which are indicated by the arrow 14. This drive 32 causes the carriage 8 to move along the tracks 4 of the frame 1 and the crossbeam 48 to move with as well as relative to the supports 6, 6*a* of the carriage. Such movements of the crossbeam 48 (and tool or tools 19) relative to the supports 6, 6*a* of the carriage 8 are ensured due to the aforediscussed design of the gear transmissions 52, 54 and 53, 56. Thus, the crossbeam 48 is caused to advance at a lesser speed than the holders 6, 6*a* so that the tool 19 remains substantially midway between the flexing tools 18 and the stop or Stops 29. This has been found to establish optimal, or at least highly satisfactory, conditions for the gathering of stacks 28 wherein the sheets 24 are properly aligned with each other.

Figure 11:
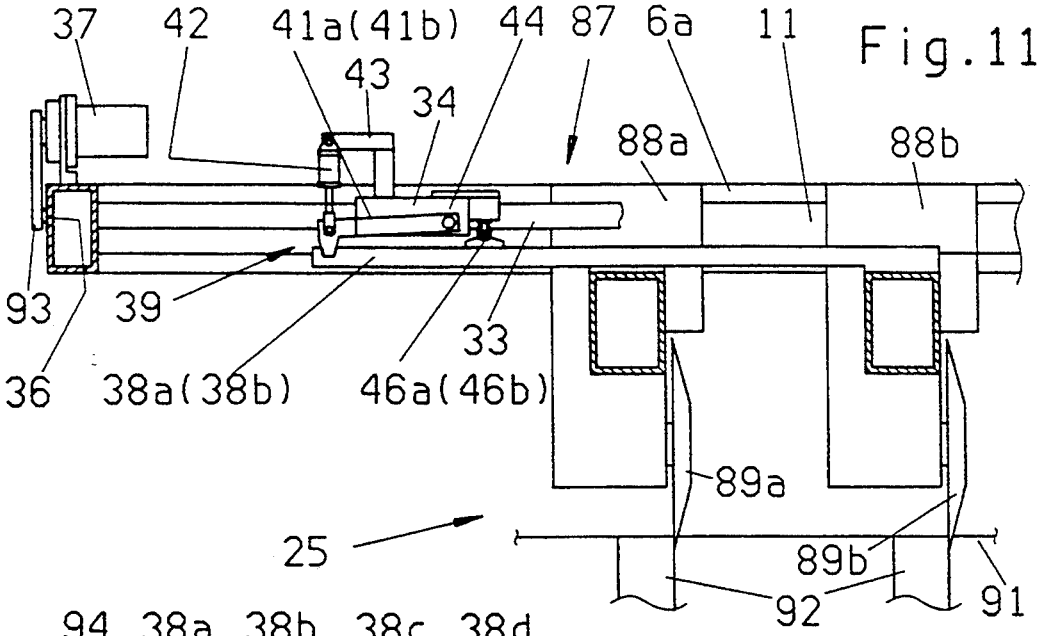
Figure 12:
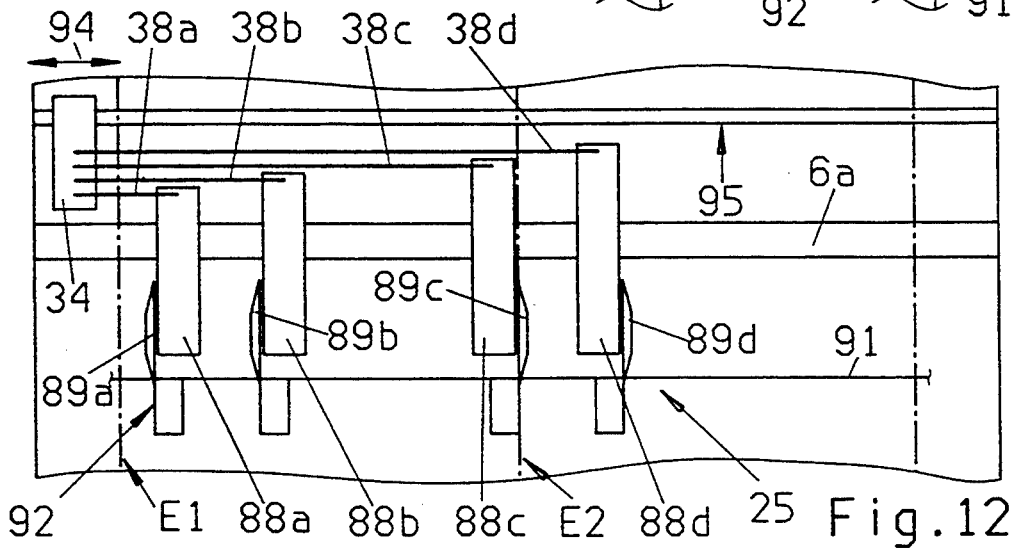
FIG. 12 is a fragmentary plan view of an apparatus which constitutes a modification of the apparatus of FIG. 11 in that it comprises four severing tools for a running web of paper-like material.
Figure 13:
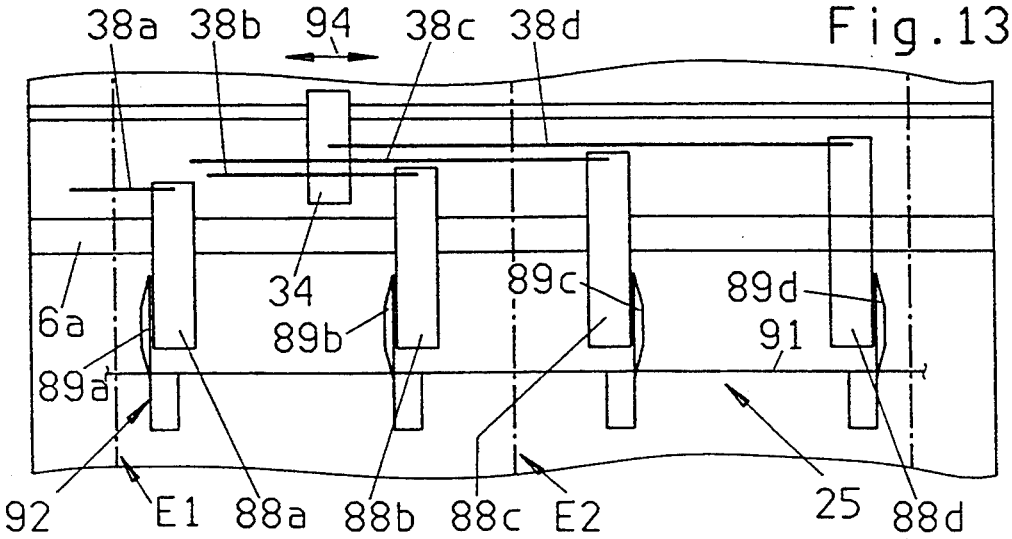
FIG. 13 illustrates the structure of FIG. 12 but with the tools in a different distribution as seen transversely of the path for the running web.

FIGS. 11, 12 and 13 show that the invention can be embodied with equal advantage in apparatus 87 which manipulate sheet-like products in a different way. The apparatus of FIGS. 11 to 13 is designed to subdivide a relatively wide web 91 of paper or the like into two or more narrower webs or strips, i.e., into two or more series of coherent sheet-like products. Each strip can be thereupon severed by a cross cutter at desired intervals to yield a stream of discrete sheets which can be manipulated in a manner as described with reference to FIGS. 1 to 10. FIG. 11 shows two cutting or severing tools which cooperate to subdivide the web 91 into three strips having identical or different widths. FIGS. 12 and 13 show a total of four cutting or severing tools which can cooperate to subdivide a web into five strips. Of course, one or more tools can remain idle so that the apparatus 87 can be used with equal advantage to divide a web 91 into only two or into four strips. Shifting of one or more tools is necessary in the directions which are indicated by a double-headed arrow 94 if the apparatus 87 is to be adjusted for subdivision of a web 91 into a different number of strips and/or into strips having widths different from those of previously formed strips. Each tool comprises a knife holder 88 and a rotary knife 89. The holders 88*a*, 88*b* of FIG. 11 are movable relative to each other and relative to the frame, and these holders are provided with distancing elements 38*a*, 38*b*, respectively, which can be coupled to a locating device 34 in the same way as described hereinbefore. FIGS. 12 and 13 show four holders 88*a* to 88*d* for the respective rotary knives 89*a* to 89*d*, and each holder is provided with a distancing element 38*a*, 38*b*, 38*c*, 38*d*, respectively, which can be coupled to the locating device 34.

The support 6*a* which is shown in FIGS. 11 to 13 is provided with a guide 11 for the knife holders 88*a*, 88*b* or 88*a*–88*d*. Each of the rotary knives cooperates with a counterknife 92. The major portions of the rotary knives are located at a level above and the counterknives 92 are located at a level below the path 25 for the web 91.

The locating device 34 is movable transversely of the path 25 in the same way as described in connection with FIGS. 1 to 10. Thus, the device 34 is reciprocable along guide rods 33 and can be coupled to the distancing elements 38*a*, 38b (FIG. 11) or 38*a* to 38*d* (FIGS. 12 and 13) by male and female Coupling or detent members. FIG. 11 shows male detent members in the form of pawls 41*a*, 41*b* and female detent members 39 having sockets or recesses for the pallets of the respective pawls. The feed screw 36 is driven by the reversible motor 37 through the medium of a belt or chain transmission 93. The pawls 41*a*, 41*b* of FIG. 11 are pivotable by discrete pneumatic or hydraulic cylinder and piston units 42 mounted on the arms 43 of the locating device 34. The distancing elements 38*a*, 38*b* and 38*a* to 38*d* have different lengths, depending on the desired spacing of the tools including the knife holders 88*a*, 88*b* and knives 89*a*, 89*b* or knife holders 88*a*–88*d* and knives 89*a*–89*d* when the tools and the locating device 34 are maintained in their parking positions and the distancing elements are coupled to the device 34. When the parts 34 and 88*a*, 88*b* or 34 and 88*a* to 88*d* are maintained in their respective parking positions, the cylinder and piston units 42 can be actuated to simultaneously engage all of the male coupling members (such as the pawls 41*a*, 41*b* of FIG. 11) with the respective female coupling members 39. The sensors 44 and the trips (two shown in FIG. 11, as at 46*a*, 46*b*) serve the aforediscussed purpose of ensuring that the units 42 can be actuated when the corresponding male coupling members 41 are properly aligned with the associated female coupling members 39.

FIG. 12 illustrates the locating device 34 and the four knife holders 88*a* to 88*d* in their parking positions. This Figure further shows two parallel reference planes E1 and E2 which extend in the direction of advancement of the web 91 through the severing station where the knives 89*a* to 89*d* cooperate with the respective counterknives 92 to sever the web. The plane E1 is located at the left-hand side of the path 25 and the plane E2 is located midway or nearly midway between the left-hand and the right-hand sides of such path. The plane of the web 91 in the path 25 is normal to the reference planes E1 and E2. The parked tools including the knife holders 88*a*, 88*b* are located in preselected positions relative to the plane El, and the parked tools including the knife holders 88*c*, 88*d* are located in preselected positions relative to the plane E2. The parked tools including the knife holders 88*c*, 88*d* are spaced apart from the parked tools including the knife holders 88*a* and 88*b*. All four distancing elements 38*a* to 38*d* are coupled to the locating device 34 (see FIG. 12).

If the mutual spacing of the cutting tools including the knife holders 88*a* to 88*d* is to be changed so that the web 91 is to be divided into strips having widths departing from those of the previously formed strips, or if the spacing of the cutting tools is to be changed because the apparatus 87 is to manipulate a wider or a narrower web 91, the locating device 34 is moved in one of the directions which are indicated by the double-headed arrow 94 to move the holders 88*a* to 88*d* to newly selected positions relative to each other and relative to the sidewalls of the frame. The respective cylinder and piston units 42 are actuated in response to signals from a programming device to ensure that each of the four distancing elements 38*a* to 38*d* is disengaged from the locating device 34 in an optimum position of the respective knife holder. FIG. 13 shows the four knife holders 88*a* to 88*d* in their newly selected positions and the locating device 34 is still coupled to the holder 88*d*. The two outer knives 89*a*, 89*d* of FIG. 13 can be used to trim the marginal portions of the web 91, and the two median knives 89*b*, 89*c* are then used to divide the web 91 into three strips. Of course the number of holders 88 and knives 89 can be increased to five or more. The division of tools into two groups, one for each of the two reference planes E1 and E2, exhibits the advantage that the interval of idleness of the apparatus 87 in order to change the mutual spacing of the tools in directions which are indicated by the arrow 94 is reduced accordingly. If the locating device 34 is to move a large number of tools, such tools can be divided into three or more groups, and the tools of each group are caused to assume preselected positions relative to a different reference plane. This shortens the interval of time which is needed to move each of a large number of tools to a different position preparatory to subdivision of a web 91 into a different number of strips or into strips having widths which are different from those of the previously formed strips.

The counterknives 92 are shiftable jointly with the respective rotary knives 89.

If the apparatus 87 is to be designed in such a way that one or more tools including rotary knives and counterknives are to be adjusted transversely of the path 25 as well as in or counter to the direction of advancement of the web 91, the means for moving selected tools in or counter to the direction of arrow 95 is designed in the same way as described with reference to FIGS. 1 to 10.

Furthermore, the improved apparatus can be utilized to manipulate discrete or coherent sheet-like products in a number of additional ways. For example, the apparatus can utilize stamping tools, cross cutting tools, tools composed of or utilizing belt or chain conveyors, stationary knives and/or punching tools. Such tools can be used with or without sheet guiding, depressing, locating, orienting and/or arresting tools. Some or all of the tools can be adjusted in directions transversely of and/or longitudinally of the path 25 for discrete sheet-like products 24 or for series of coherent sheet-like products (such as the web 91 or the strips which are obtained by severing the web 91 in a manner as described with reference to FIGS. 11 to 13).

An important advantage of the improved apparatus is that it can rapidly and predictably select a number of different positions for one, two or more tools which must be adjusted transversely and/or longitudinally of the path 25. Furthermore, the operation of the improved apparatus can be automated to a desired extent and the tools can be repeatedly moved to selected positions for optimal manipulation of discrete sheet-like products or of series of coherent sheet-like products.

Another important advantage of the improved apparatus is its simplicity. Thus, a single prime mover (such as 37) is necessary to change the positions of all tools in directions transversely of the path 25, and a single prime mover (such as the motor of the longitudinal drive 32) is needed to move some or all of the tools in or counter to the direction of advancement of sheet-like products 24 or web 91.

An advantage of the structure which is shown in FIGS. 6 and 7 is that the tensioning of the belt or belts forming part of the depressing tool or tools 17 need not be checked and adjusted subsequent to each change of setup because these belts are automatically disengaged from the driving member 61 and are automatically clamped to the respective pulleys 58*b*, 58*c* when the depressing tool or tools 17 are to be moved transversely of the path 25. Furthermore, such clamping and disengagement from the driving member 61 are terminated as soon as the respective depressing tool 17 assumes a newly selected position. An advantage of the single common driving member 61 is that the belt or belts of each depressing tool 17 are invariably driven at an optimum speed, that the means for driving such belt or belts occupies a small amount of space and that the number of parts which are needed to drive the belt or belts of the depressing tool or tools can be reduced to a minimum.

The stop or stops 29 exhibit the advantage that their arresting members 76 can reliably intercept the oncoming sheets 24 in optimal positions for the formation of stacks 28 wherein the sheets accurately overlap each other. This is important for further manipulation of stacks 28, e.g., for wrapping prior to introduction into boxes or other types of containers. Moreover, the means for lifting the arresting members 76 ensures that the stop or stops 29 can be shifted transversely of the path 25 and/or that the belt or belts of the depressing tool or tools 17 can be shifted transversely of the path even though the lower end portions of the arresting members 76 normally extend downwardly beyond the lower reach(es) of the belt(s) of the tool(s) 17.

It will be noted that, with the exception of the motor 62 and the belt or chain transmission 62*a* between the output element of this motor and the driving member 61 (see FIG. 1), all parts of the improved apparatus are or can be installed between the sidewalls 2*a*, 2*b* of the frame 1. This contributes to compactness of the apparatus. In fact, the parts 62 and 62*a* can be installed between the sidewalls 2*a* and 2*b* without departing from the spirit of the invention. An advantage of the just discussed design is that the parts of the improved apparatus are less likely to be damaged not only when the apparatus is in actual use but also when the apparatus is idle.

The transmissions 52, 54 and 53, 56 contribute to simplicity of the apparatus while at the same time ensuring that the tool or tools 19 can be adjusted relative to the other tools to assume optimal positions regardless of the format of sheets 24 which are manipulated in the improved apparatus.

An additional important advantage of the improved apparatus is its versatility. This apparatus can be designed to manipulate all kinds of sheet-like products in a number of different ways including stacking, severing, punching, aligning, orienting, depressing, stiffening (flexing) and others.

Still another important advantage of the improved apparatus is that it can complete the shifting of one or more tools to any one of a number of different positions within a short period of time. This ensures that any changes of setup are completed with a minimum of delay so that the down times of the apparatus are shorter than those of heretofore known apparatus for stacking, severing and/or otherwise manipulating discrete sheet-like products or webs or strips of coherent sheet-like products.

Another important advantage of the improved apparatus is that each of a relatively small or a larger number of discrete tools can be moved to a selected position independently of each other tool. For example, the locating device 34 can shift any reasonable number of tools transversely of the path 25 to any one of a number of different positions. All that is necessary is to disengage the device 34 from the respective distancing element 38 when the respective tool (e.g., 17 or 18 or 19) reaches a selected position upon movement in one of the directions which are indicated by the arrow 16 of FIG. 1. The distancing elements 38 contribute to simplicity of adjustment of tools in the direction of arrow 16 and render it possible to shorten the distances through which the locating device 34 and/or a tool must be shifted before the tool reaches a newly selected position. The periods of time which are required to complete the movements of the tools to their newly selected positions can be reduced still further by resorting to the feature which was described with reference to FIGS. 12 and 13, i.e., to the positioning of groups of tools relative to discrete reference planes (such as E1 and E2).

The sensors 44 also contribute to a shortening of the interval which is necessary to complete the transfer of one or more tools to newly selected positions. Such sensors render it possible to rapidly return the tools to their parking positions without resorting to electronic memories for storage of information pertaining to the actual and parking positions of various tools.

The improved orienting tool or stop 29 can be used in the apparatus of FIGS. 1 to 10 as well as in conventional apparatus. This tool exhibits features which are believed to be novel and patentable per se regardless of the construction and mode of operation of other parts of the apparatus in which the stop is put to use. The utilization of a grating or gate containing a set of parallel elongated strip-shaped arresting members 76 renders it possible to ensure proper orientation and predictable stoppage of wide or narrow sheet-like products 24 as well as convenient adjustment of such stop relative to other tools and/or vice versa. Thus, all that is necessary is to lift the arresting members 76 to a given level in order to avoid interference with movements of certain other tools, or to permit predictable movements of the stop transversely of the path 25. The provision of means for retaining selected arresting members **76*a* in their raised positions ensures that the stop 29 does not interfere with movements of the belt or belts forming part of one or more adjacent tools, such as one or more product depressing tools 17. The width of the grating including the arresting members 76 can be selected in such a way that the stop 29 can remain in a selected position regardless of the positions of other tools and that the arresting members 76 can reliably intercept successive foremost sheets 24** of one, two or more discrete streams of such sheets.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for stacking sheet-like products at a stacking station, comprising means for transporting the products in a predetermined direction along a predetermined path, said stacking station being adjacent said path and said transporting means including means for transporting at least one stream of successive sheet-like products along said path to said station; tool positioning means including a plurality of movable holders adjacent and disposed at a level above said path, said holders being elongated in said predetermined direction; product engaging means including at least one tool for each of said holders, said tools being movable with and relative to the respective holders and forming at least one row extending transversely of said path; and means for automatically adjusting said tools relative to said path, said adjusting means comprising at least one guide, means for shifting said holders transversely of said predetermined path, at least one common support for said at least one row of tools, means for moving said at least one common support relative to said holders in said predetermined direction, a locating device, means for moving said device along said at least one guide relative to said path, and means for coupling said device with at least one of said tools, said adjusting means being operative to automatically move said tools between a plurality of different positions to thereby conform the positions of said tools to different sizes of sheet-like products when the apparatus is to be set up to switch from stacking of products having a first size to stacking of products having a different second size.

2. The apparatus of claim 1, wherein said tools are spaced apart from each other in said predetermined direction.

3. The apparatus of claim 1, wherein one of said tools is a product guiding tool and said product guiding cool includes a lateral guiding tool for the products in said path, said tools further including a tool for flexing the products in said path and a product depressing tool including a plurality of pulleys on the respective holder and at least one endless belt trained over said pulleys.

4. The apparatus of claim 1, wherein said shifting means includes means for moving said holders back and forth relative to said common support.

5. The apparatus of claim 1, further comprising a track for each of said holders, said holders being movable relative to the respective tracks in said predetermined direction.

6. The apparatus of claim 1, wherein said adjusting means further comprises at least two common supports, said supports extending transversely of said predetermined direction.

7. The apparatus of claim 6, wherein said means for moving said at least two common supports in said predetermined direction includes means for moving said supports at different speeds.

8. The apparatus of claim 6, wherein said means for moving said supports in said predetermined direction includes means for moving said supports through different distances.

9. The apparatus of claim 1, wherein one of said tools is a product orienting tool and said product orienting tool comprises a stop which is located in said path to intercept successive products of the at least one stream at said station, said adjusting means comprising means for moving said orienting tool in and counter to said predetermined direction.

10. The apparatus of claim 9, wherein said tools further comprise at least one product depressing tool disposed above said path and including a plurality of endless flexible belts having lower reaches engaging successive sheets of the at least one stream, said belts being disposed in planes which extend in said direction and are normal to said path, said stop comprising a plurality of spaced parallel elongated sheet arresting members alternating with the lower reaches of said belts.

11. The apparatus of claim 10, wherein said adjusting means further comprises a support carrying said stop and extending transversely of said path.

12. Apparatus for stacking sheet-like products at a stacking station, comprising means for transporting the products in a predetermined direction along a predetermined path, said stacking station being adjacent said path and said transporting means including means for transporting at least one stream of successive sheet-like products along said path to said station; tool positioning means including at least one movable tool holder adjacent and disposed at a level above said path, said at least one holder being elongated in said predetermined direction; product engaging means including tools movable with and relative to said at least one holder, said tools including a plurality of product depressing tools each comprising an endless flexible belt and said tools further including a common rotary driving member for said belts, means for rotating said driving member and means for temporarily disengaging said belts from said driving member, at least during shifting of said at least one holder transversely of said path; and means for automatically adjusting said tools relative to said path, said adjusting means comprising at least one guide, means for shifting said at least one holder transversely of said path, a locating device, means for moving said device along said at least one guide relative to said path, and means for coupling said device with at least one of said tools, said adjusting means being operative to automatically move said tools between a plurality of different positions to thereby conform the positions of said tools to different sizes of sheet-like products when the apparatus is to be set up to switch from stacking of products having a first size to stacking of products having a different second size.

13. The apparatus of claim 12, wherein said tool positioning means comprises a plurality of shiftable holders and a track for each of said holders, each depressing tool being mounted on a discrete holder and each of said disengaging means being provided on the track for the holder mounting the respective disengaging means.

14. The apparatus of claim 12, further comprising a track for said at least one holder, each of said product depressing tools further comprising two pulleys on said track, each belt being trained over the respective pulleys and said driving member being disposed between the pulleys of each of said pairs, each of said depressing tools further comprising means for moving at least one of the respective pulleys relative to said driving member to loosen the respective belt at said driving member, and means for clamping the belt to at least one of the respective pulleys.

15. Apparatus for stacking sheet-like products at a stacking station, comprising means for transporting the products in a predetermined direction along a predetermined path, said stacking station being adjacent said path and said transporting means including means for transporting at least one stream of successive sheet-like products along said path to said station; tool positioning means including at least one movable holder adjacent said path; product engaging means including at least two tools movable with and relative to said at least one holder, said tools including at least one product orienting tool comprising a stop located in said path to intercept successive products of the at least one stream at said station, said tools further including at least one product depressing tool disposed above said path and including a plurality of endless flexible belts having lower reaches engaging successive sheets of the at least one stream, said belts being disposed in planes which extend in said direction and are normal to said path, said stop comprising a plurality of spaced parallel elongated sheet arresting members alternating with the lower reaches of said belts and means for lifting said arresting members above said path to permit movements of said belts transversely of said path; and means for automatically adjusting said tools relative to said path, said adjusting means comprising at least one guide, means for moving said at least one product orienting tool in and counter to said predetermined direction, a locating device, means for moving said device along said at least one guide relative to said path, and means for coupling said device with at least one of said tools, said adjusting means being operative to automatically move said tools between a plurality of different positions to thereby conform the positions of said tools to different sizes of sheet-like products when the apparatus is to be set up to switch from stacking of products having a first size to stacking of products having a different second size.

16. The apparatus of claim 15, wherein said lifting means includes means for maintaining selected arresting members at a level above the lower reaches of said belts.

17. The apparatus of claim 16, wherein said maintaining means comprises first detent members on said arresting members, second detent members adjacent said stop and each in register with at least one of said first detent members in the lifted positions of the respective arresting members, and means for engaging selected second detent members with the registering first detent members in the lifted positions of the respective arresting members.

18. The apparatus of claim 17, wherein said arresting members are mounted for gravitational descent into said path when released by said lifting means.

* * * * *